United States Patent [19]

Stinson

[11] Patent Number: 4,842,436

[45] Date of Patent: Jun. 27, 1989

[54] CHART ORGANIZER

[76] Inventor: Ed W. Stinson, 120 LeMont Dr., West Monroe, La. 71291

[21] Appl. No.: 227,063

[22] Filed: Aug. 1, 1988

Related U.S. Application Data

[63] Continuation-in-part of Ser. No. 943,173, Dec. 18, 1986.

[51] Int. Cl.[4] ..... B42F 13/00

[52] U.S. Cl. ..... 402/80 R; 211/54.1

[58] Field of Search ..... 211/54.1; 402/80 R, 402/80 L

[56] References Cited

U.S. PATENT DOCUMENTS 3,196,452 7/1965 Mullins et al. ..... 211/54.1

4,632,586 12/1986 Erickson ..... 402/80 R X

FOREIGN PATENT DOCUMENTS 3006606 8/1981 Fed. Rep. of Germany .... 402/80 R

*Primary Examiner*—Paul A. Bell

*Attorney, Agent, or Firm*—John M. Harrison

[57] ABSTRACT

A chart organizer for organizing and stacking recording charts and inserting multiple units of the superimposed recording charts on a recording meter, which chart organizer includes a base plate, a round keyhole post projecting from the base plate in perpendicular relationship for engaging the keyhole in at least one recording chart and a round keyhole slot post of smaller diameter and longer than the keyhole post, projectig from the base plate in spaced relationship with respect to the keyhole post, for engaging the bottom or slot end of the keyhole slot in the recording chart. Primary features of the chart organizer are the post spacing and the relative lengths of the keyhole post and the keyhole slot post. The post spacing equals the length of the keyhole slot in the recording chart or charts, in order to minimize damage to the recording chart(s) which are placed on the chart organizer. Another primary feature of the invention is a clip which serves to preserve the superimposed relationship between the recording charts, wherein the keyhole slots are aligned while loading the recording charts on the recording meter.

20 Claims, 1 Drawing Sheet

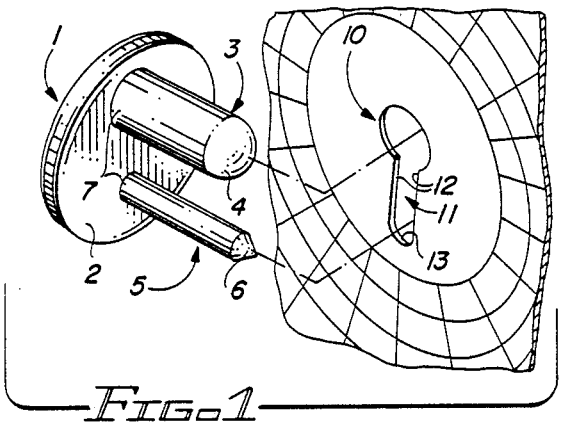
FIG. 1
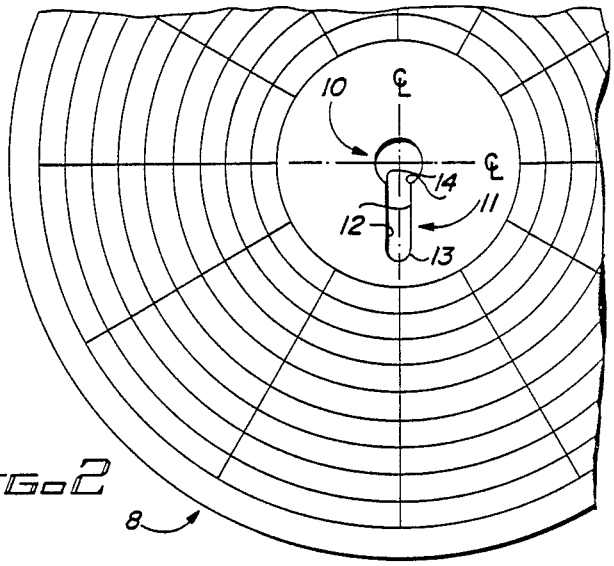
FIG. 2
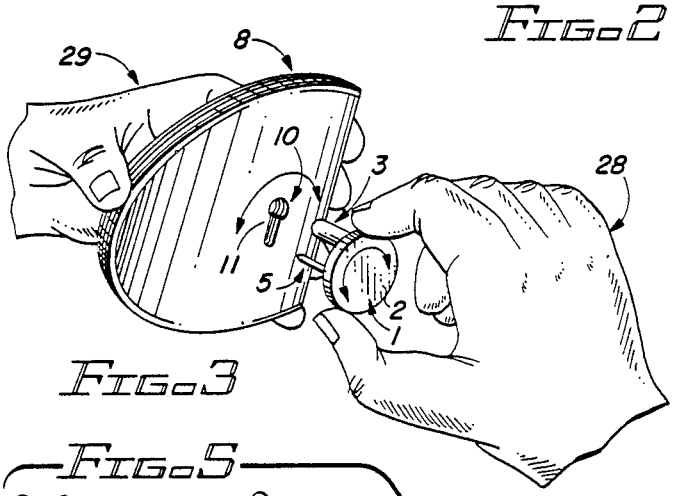
FIG. 3
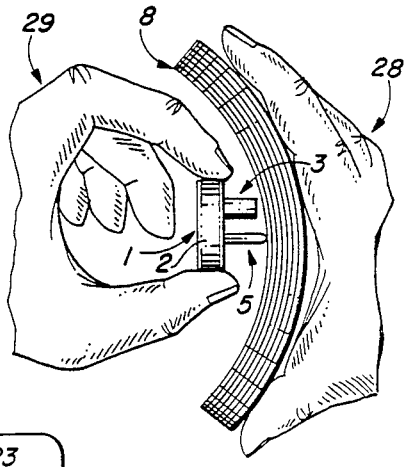
FIG. 4
FIG. 5
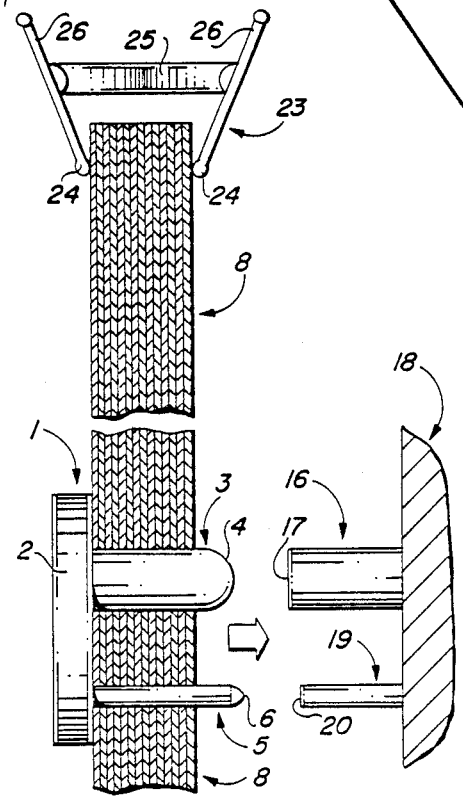
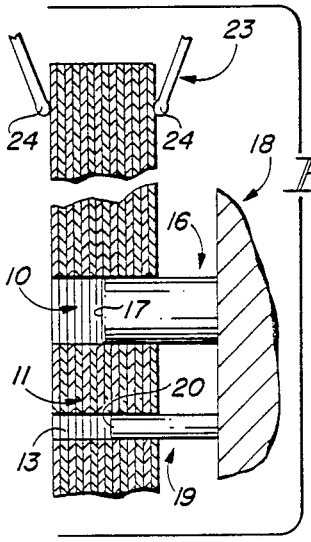
FIG. 6
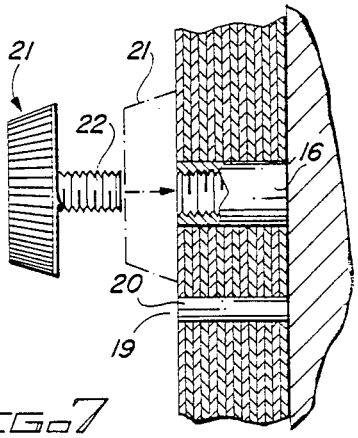
FIG. 7

CHART ORGANIZER

BACKGROUND OF THE INVENTION

1. Cross-Reference to Related Application

This application is a continuation-in-part of my copending U.S. patent application Ser. No. 06/943,173, Filed Dec. 18, 1986.

2. Field of the Invention

This invention relates to chart changing mechanisms for recording meters and more particularly, to a chart organizer for organizing and stacking multiple, superimposed recording charts, in order to accurately load the recording charts on a recording meter without damaging the charts. The chart organizer of this invention is characterized by a round base plate of selected thickness provided with an outwardly-extending, round keyhole post having a blunt end. A round keyhole slot post of smaller diameter and longer than the keyhole post has a tapered end and projects from the base in spaced relationship with respect to the keyhole post. In a most preferred embodiment of the invention, the distance between the keyhole post and the keyhole slot post is equal to the length of the keyhole slot provided in the recording charts, in order to minimize damage to the keyhole slot and keyhole of the recording charts when the recording charts are loaded on the chart organizer and are transferred from the chart organizer to the recording meter. In another preferred embodiment, a clip is used to help organize and align the keyhole slots in the charts for inserting the charts on the recording meter.

A problem which is frequently realized in transferring multiple recording charts from a carrier apparatus to a recording meter is that of damaging either the keyhole slot or the keyhole provided in the very thin, fragile, paper recording charts. If a chart is torn, bent or split in the area where the keyhole slot joins the keyhole, then the chart-release button, which is mounted on the end of a hub in the chart recorder, sometimes fails to engage this damaged area of the keyhole slot and does not remove the outside, exposed recording chart from the other superimposed charts. Data is then improperly recorded on the recording charts. Both the keyhole and the keyhole slot are very easily damaged by tearing or folding when placed on the carrying device or when transferred from the carrying device to the recording meter. This problem is intensified in wet or humid weather, when the paper recording charts are damp and more easily torn or folded. Since multiple units of the recording charts are normally stacked on carrying device and then transferred from the carrying device to the recording meter using the technique hereinafter described, the keyhole slots and keyholes are very easily misaligned and damaged, either during the transportation or transfer process and are frequently rendered unfit for us in the recording meter.

DESCRIPTION OF THE PRIOR ART

Chart recorders or recording meters and various devices for organizing and loading recording charts on recording meters are known in the art. Typical of these devices is the "Chart Changing Mechanisms" disclosed in U.S. Pat. No. 3,196,452, dated July 20, 1965, to O. E. Mullins, et al. The chart changing mechanisms disclosed in this patent include a tool (see FIG. 4) which is designed to position recording charts properly on the hub and drive pin of a recording meter. The tool is fitted with an outwardly-extending, cylindrical spindle provided with a pilot which engages a recess in the hub of in the recording meter. A square pilot pin also extends from a base plate in spaced relationship with respect to the spindle and engages the square drive pin of the recording meter. A small, cylindrical lug projects from the end of the pilot pin for registering with an opening in the end of the drive pin of the recording meter. It is significant that the spacing between the spindle and the pilot pin is such that the pilot pin engages the keyhole slot of the recording charts at a point immediately below the keyhole itself. Since the pilot pin is square in cross-section and engages the keyhole slot at a point immediately below the keyhole where the chart-release button engages the recording chart to remove it from the recording meter, if the pilot pin causes any damage in this area of the keyhole slot, the outside recording chart will not be properly discharged and will be retained on the recording meter, thus preventing proper recording of data on the exposed recording chart.

It is an object of this invention to provide a new and improved chart organizer for organizing, containing and transferring superimposed recording charts to a recording meter in a quick and efficient manner, with minimum damage to the recording charts.

Another object of this invention is to provide a new and improved chart organizer for loading recording charts on recording meters, which chart organizer is characterized by a cylindrical keyhole post and a diametrically smaller, but longer cylindrical keyhole slot post projecting in spaced, parallel relationship from a base plate, wherein the spacing between the keyhole post and the keyhole slot post equals the length of the keyhole slot in the recording charts, in order to minimize damage and maximize organization of the recording charts on the chart organizer and transferring of the recording charts from the chart organizer to a recording meter.

Yet another object of this invention is to provide an improved recording chart organizer and loader which includes a base plate, a round, blunt keyhole post and a round keyhole slot post of smaller diameter than the keyhole post, the keyhole slot post being longer than the keyhole post, having a tapered tip and projecting from the base plate in spaced, parallel relationship and wherein the spacing between the keyhole post and the keyhole slot post is equal to the spacing between the keyhole and the end of the keyhole slot.

Still another object of this invention is to provide chart organizer for organizing, carrying and transferring recording charts to a recording meter, which chart organizer is characterized by round keyhole post projecting from a base plate and a round keyhole slot post of smaller diameter and greater length projecting in spaced relationship from the base plate, wherein the distance between the keyhole post and the keyhole slot post is equal to the length of the keyhole slot in the recording charts, in order to minimize damage to the keyhole slot and the keyhole when the recording charts are loaded on the chart organizer and ar transferred from the chart organizer to the recording meter.

SUMMARY OF THE INVENTION

These and other objects of the invention are provided in a new and improved chart organizer for receiving, organizing and loading recording charts on a recording meter with minimal damage to the recording charts, which chart organizer is characterized by a round base plate of selected thickness provided with a projecting, blunt cylindrical keyhole post and a longer, but smaller in diameter, cylindrical slot post spaced from the keyhole post, wherein the spacing between the keyhole post and the keyhole slot post is equal to the length of the keyhole slot and the keyhole post and keyhole slot post conform substantially to the shape of the keyhole and keyhole slot in the recording charts, in order to minimize such damage. In a preferred embodiment, a clip is also provided to engage the edges of the charts and secure the superimposed recording charts together, align the respective keyhole slots and further reduce chart damage.

BRIEF DESCRIPTION OF THE DRAWINGS

The invention will be better understood by reference to the accompanying drawing, wherein:

FIG. 1 is a perspective view of a preferred embodiment of the chart organizer of this invention illustrated in alignment with a conventional recording chart;

FIG. 2 is a front elevation, partially in section, of a conventional recording chart having a conventional keyhole and keyhole slot provided therein;

FIG. 3 is a perspective view of the chart organizer illustrated in FIG. 1, with multiple recording charts held in one hand and the chart organizer held in the other hand in alignment with the keyhole and keyhole slots in the charts;

FIG. 4 is a side elevation of the chart organizer held in one hand to engage the kehole and keyhole slots in multiple charts held in the other hand;

FIG. 5 is a side elevation of the chart organizer with multiple charts mounted in alignment with the plate shaft and drive pin of a conventional recording meter;

FIG. 6 is elevation of the chart organizer with multiple charts loading on the and drive pin of the conventional recording meter; and FIG. 7 a side view of the recording meter illustrated in FIG. 5, with the recording charts loaded in functional position on the plate shaft thereof and the chart release button positioned for mounting on the plate shaft.

DESCRIPTION OF THE PREFERRED EMBODIMENTS

Referring initially to FIGS. 1 nd 2 of the drawing, in a preferred embodiment of the invention the chart organizer of this invention is generally illustrated by reference numeral 1. The chart organizer 1 is characterized by a flat, round base plate 2, with a cylindrical keyhole post 3 projecting from one face thereof and terminating in a blunt, rounded keyhole post end 4. A cylindrical keyhole slot post 5 extends from the base plate 2 in spaced, parallel relationship with respect to the keyhole post 3 and is characterized by a tapered, pointed slot post end 6, which extends beyond the keyhole post end 6 of the keyhole post 3, as illustrated. The keyhole post 3 is larger in diameter than the keyhole slot post 5 and is designed to register with a keyhole 10 provided in the conventional recording chart 8, illustrated in both FIGS. 1 and 2. Furthermore, the keyhole slot post 5 is designed to register with the keyhole slot 11, extending from the keyhole 10 in the recording chart 8, at the slot end 13. In a most preferred embodiment of the invention, the post spacing 7 between the nearest points on the circumferences of the keyhole post 3 and the keyhole slot post 5, respectively, is equal to the length of the parallel slot margins 12, which extend from the slot shoulders 14 of the keyhole 10, to join at the slot end 13 of the keyhole slot 11, as illustrated. Accordingly, it will be appreciated by those skilled in the art that the keyhole post 3 is sized and designed to register with the keyhole 10, while the smaller keyhole slot post 5 i designed to first engage the keyhole slot 11 at the slot end 13, such that the recording chart 8 is slidable on the chart organizer 1 without undue stress exerted in the keyhole 10 at the slot shoulders 14, along the slot margins 12 or at the slot end 13 of the keyhole slot 11. This close tolerance between the keyhole post 3 and the keyhole 10 and between the keyhole slot post 5 and the keyhole slot 11 at the slot end 13, respectively, is necessary in order to minimize damage to either the slot shoulders 14 or to that portion of the slot margins 12 which extend immediately below the slot shoulders 14 that are engaged by the chart release button 21 when the outside recording chart 8 is automatically removed from the plate shaft 16.

Referring now to FIGS. 3–7 of the drawings, the chart organizer 1 is used as a tool to organize the recording charts 8 and transfer multiple recording charts 8 from a stacked position on the keyhole post 3 and the keyhole slot post 5 as illustrated in FIG. 5, to a final position on the plate shaft 16 and drive pin 19 of a recording meter 18, as illustrated in FIG. 7. The recording charts 8 are loaded on the chart organizer 1 by initially cupping them between the thumb and fingers of one hand, grossly aligning the respective keyholes 10 and bending the recording charts 8 into concave configuration as illustrated in FIG. 4. The recording charts 8 are then gently pressed against the keyhole slot post 5 with an oscillating motion of the chart-supporting hand, to align the respective keyhole slots 11 and are subsequently loaded on the keyhole slot post 5 and the shorter keyhole post 3, as illustrated in FIG. 5. It is important that the keyhole slot post 5 first register with the keyhole slot 11 at the slot end 13 of each of the recording charts 8, in order to engage the respective slot margins 12 with the tapered slot post tip 6 and initiate alignment of the respective slot margins 12 and slot shoulders 14 before entry of the keyhole post 3 into the respective keyholes 10. This alignment of the respective keyhole slots 11 by penetration of the keyhole slot post 5 is optimized by twisting the chart organizer back and forth with the other hand. After loading of the recording charts 8 on the chart organizer 1 is accomplished, transfer of the aligned recording charts 8 from the keyhole post 3 and keyhole slot post 5 is effected by initially placing the keyhole post end 4 of the keyhole post 3 in alignment with the shaft end 17 of the plate shaft 16 and the slot post end 6 of the keyhole slot post 5 in alignment with the pin end 20 of the drive pin 19. The recording charts 8 are then moved in the direction of the arrow as illustrated in FIGURE 5, from the keyhole post 3 and the keyhole slot post 5 onto the plate shaft 16 and the drive pin 19, respectively, as illustrated in FIG. 6. As further illustrated in FIG. 5 of the drawing, proper alignment of the respective keyholes 10 and keyhole slots 11 in the recording charts 8 may be maintained by attaching the clip feet 24 of the chart clip 23 to the edge of the recording charts 8 after the recording charts 8 are loaded onto the chart organizer 1 and before the transfer operation is initiated. Referring again to FIG. 5 of the drawing, in a most preferred embodiment of the invention the chart clip 23 is attached to the top edges of inside and outside ones of the superimposed recording charts 8, in order to maintain the recording charts 8 in a tight, aligned configuration on the keyhole post 3 and the keyhole slot post 5, as illustrated. The chart clip 23 is conventional in design, with a clip spring 25 spanning a pair of clip feet 24, which engage the outside and inside ones of the recording charts 8 and spaced clip arms 26, which are designed to release the clip feet 24 from the recording charts 8 when pressure is applied inwardly, as illustrated by the arrows.

Referring now to FIG. 7 of the drawings, after the transfer of the recording charts 8 to the plate shaft 16 and the drive pin 19 of the recording meter 18 has been accomplished, a conventional chart release button 21 is attached to the plate shaft 16 and the recording meter 18 is ready for conventional operation. The chart release button 21 is designed to maintain the recording charts 8 in the functional position illustrated in FIG. 6 and to facilitate individual removal of the recording charts 8 from the outside in, when recordation is completed on the outside one of the recording charts 8.

It will be recognized by those skilled in the art that the chart organizer of this invention is simple in design and easy to operate and requires no complex machining or construction, in order to facilitate alignment with the shaped ends of a conventional plate shaft 16 and pin end 20 of conventional recording meters. Furthermore, the relative lengths of, and the post spacing 7 between, the keyhole post 3 and the keyhole slot post 5 are optimized, in order to support and stack the recording charts 8 in such a manner as to minimize or prevent damage to either the slot shoulders 14 or the slot margins 12 which define the keyhole slot 11, as illustrated in FIGS. 1 and 2. Accordingly, the chart organizer 1 can be used to organize a large number of recording charts 8 quickly and efficiently, with minimum damage to the recording charts 8.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A chart organizer for arranging and organizing recording charts having keyholes and keyhole slots, comprising a base plate, a keyhole post extending from said base plate for engaging the keyholes, respectively, and a keyhole slot post extending from said base plate in substantially parallel relationship with respect to said keyhole post for engaging the keyhole slots, respectively, wherein said keyhole post is spaced from said keyhole slot post a distance substantially equal to the length of the keyhole slots in the recording charts and said keyhole slot post is longer than said keyhole post.

2. The chart organizer of claim 1 wherein said keyhole post and said keyhole slot post are cylindrical.

3. The chart organizer of claim 1 wherein the extending end of said keyhole post is rounded.

4. The chart organizer of claim 1 wherein the extending end of said keyhole slot post is tapered to define a point.

5. The chart organizer of claim 1 wherein said keyhole post and said keyhole slot post are cylindrical, the extending end of said keyhole post is rounded and the extending end of said keyhole slot post is tapered to define a point.

6. The chart organizer of claim 1 further comprising clip means removably spanning the recording charts for biasing the recording charts together, stabilizing the recording charts with respect to each other and maintaining substantial alignment of the keyholes and the keyhole slots, respectively.

7. The chart organizer of claim 6 wherein said keyhole post and said keyhole slot post are cylindrical.

8. The chart organizer of claim 7 wherein said keyhole post is larger in diameter than said keyhole slot post.

9. The chart organizer of claim 8 wherein the extending end of said keyhole post is rounded and the extending end of said keyhole slot post is tapered to define a point.

10. A chart organizer for arranging, organizing and aligning recording charts having symmetrical keyholes and keyhole slots, said chart organizer comprising a round base plate having a selected thickness; a cylindrical keyhole post extending from said base plate in substantially perpendicular, off-center relationship; a cylindrical keyhole slot post extending from said base plate in off-center, spaced, substantially parallel relationship with respect to said keyhole post, said keyhole slot post being longer than said keyhole post; and a clip adapted for engaging the recording charts, biasing said recording charts together and maintaining the recording charts in organized configuration when said keyhole post is first extended through the keyholes and said keyhole slot post is then extended through the keyhole slots of the recording charts.

11. The chart organizer of claim 10 wherein said keyhole post is larger in diameter than said keyhole slot post.

12. The chart organizer of claim 10 wherein the extending end of said keyhole post is rounded.

13. The chart organizer of claim 10 wherein the extending end of said keyhole slot post is tapered to define a point.

14. The chart organizer of claim 10 wherein the distance between said keyhole post and said keyhole slot post i substantially equal to the length of said keyhole slots.

15. The chart organizer of claim 10 wherein:

(a) said keyhole post is larger in diameter than said keyhole slot post; and (b) the extending end of said keyhole post is rounded and the extending end of said keyhole slot post is tapered to define a point.

16. The chart organizer of claim 15 wherein the distance between said keyhole post and said keyhole slot post is substantially equal to the length of said keyhole slots.

17. A method of loading a plurality of recording charts having keyholes and keyhole slots, respectively, on a recording meter, comprising the steps of grossly aligning the keyholes and keyhole slots in the recording charts; bending the recording charts in concert with one hand; inserting the keyhole slot post of a chart organizer having a keyhole slot post and a keyhole post, into the keyhole slots at the concave side of the recording charts with the other hand, while oscillating the recording charts to align the respective keyhole slots on said keyhole slot post; projecting said keyhole post into the keyholes, respectively, to secure the recording charts on the chart organizer; and transferring the recording charts from the chart organizer to the recording meter.

18. The method according to claim 17 further comprising the step of securing a clip to the perimeter of the recording charts after the recording charts are loaded on said chart organizer, for maintaining alignment of the keyholes and keyhole slots, respectively, in the recording charts.

19. The method according to claim 17 further comprising the step of twisting the chart organizer from side to side with on hand while oscillating the recording charts with the other hand, for more efficient alignment of the keyholes and keyhole slots, respectively, in the recording charts.

20. The method according to claim 17 further comprising the steps of:

(a) securing a clip to the perimeter of the recording charts after the recording charts are loaded on said chart organizer, for maintaining alignment of the keyholes and keyhole slots in the recording charts; and (b) twisting the chart organizer from side to side with one hand while oscillating the recording charts with the other hand, for more efficient alignment of the keyholes and keyhole slots, respectively, in the recording charts.

* * * * *